US005199695A

United States Patent [19]

Nakahata et al.

[11] Patent Number: 5,199,695

[45] Date of Patent: Apr. 6, 1993

[54] CASSETTE FOR FEEDING SHEET MATERIALS

[75] Inventors: Akinobu Nakahata, Sakai; Hiroshi Kubota, Osaka; Kenji Oda, Toyonaka; Yoshinori Makiura, Kawachinagano, all of Japan

[73] Assignee: Mita Industrial Co., Ltd., Osaka, Japan

[21] Appl. No.: 835,498

[22] Filed: Feb. 14, 1992

[30] Foreign Application Priority Data

Feb. 15, 1991 [JP] Japan ..... 3-022287

[51] Int. Cl.[5] ..... B65H 1/00

[52] U.S. Cl. ..... 271/9; 271/127; 271/160; 271/171

[58] Field of Search ..... 271/9, 113, 121, 126, 271/127, 160, 161, 167, 169, 171

[56] References Cited

U.S. PATENT DOCUMENTS 4,625,641 12/1986 Jagosz et al. .
4,697,803 10/1987 Kan et al. ..... 271/127
4,940,222 7/1990 Maeno et al. .
5,076,562 12/1991 Sai et al. ..... 271/171

FOREIGN PATENT DOCUMENTS 0386737 9/1990 European Pat. Off. .
0084734 6/1980 Japan ..... 271/171
0016950 1/1987 Japan ..... 271/126
0016941 6/1987 Japan ..... 271/113
0047233 2/1988 Japan ..... 271/171
0285533 11/1989 Japan ..... 271/171

OTHER PUBLICATIONS

Patent Abstracts of Japan, vol. 8, No. 267 (M-343) (1704) Dec. 7, 1984 and JP-A 59-138 535 (Fujitsu) Aug. 9, 1984.

Patent Abstracts of Japan, vol. 9, No. 220 (E-341) (1943) Sep. 6, 1985 and JP-A-60 077 040 (Fuju Xerox) May 1, 1985.

Patent Abstracts of Japan, vol. 9, No. 226 (M-412)(1949) Sep. 12, 1985 and JP-A-60 082 539 (Fuji Xerox) May 10, 1985.

*Primary Examiner*—H. Grant Skaggs

*Attorney, Agent, or Firm*—Antonelli, Terry, Stout & Kraus

[57] ABSTRACT

A cassette for feeding sheet materials is equipped with a container body in which two sheet material-holding devices are arranged in parallel in the direction of width. Each of the sheet material-holding devices includes a pair of width restriction members which are so disposed that their positions can be freely adjusted in the direction of width. Each of the sheet material-holding devices further includes a rear end restriction member that is so disposed that its position can be freely adjusted in the feeding direction.

29 Claims, 13 Drawing Sheets

CASSETTE FOR FEEDING SHEET MATERIALS

FIELD OF THE INVENTION

The present invention relates to a cassette for feeding sheet materials on which images will be formed in an image forming machine such as an electrostatic copying machine and a laser printing machine. The words "sheet material" used in this specification stand not only for common papers in sheet form but also for the materials in the form of various kinds of sheets inclusive of envelopes which are in sheet form as a whole.

DESCRIPTION OF THE PRIOR ART

In an image forming machine, such as an electrostatic copying machine or a laser printing machine, usually a toner image is formed on an electrostatic photosensitive material that is preferably placed on a rotary drum, and the toner image is transferred onto a sheet material from the electrostatic photosensitive material so that the required image is formed on the sheet material. The sheet materials on which the images will be formed include not only common papers but also a variety of sheet materials such as an envelope, post card or the like. When the sheet material on which the image will be formed is an envelope or a post card, images related to the name and address of the receiver or designation are usually formed on the surface of the envelope or the post card based on data signals sent from a computer or a word processor.

When a so-called regular-size envelope or a post card is used as a sheet material on which the image will be formed, the width of the regular-size envelope or of the post card is considerably smaller than the width of a sheet of paper of the standard size, such as JIS A4 or B5. and is smaller than one-half the width of the electrostatic photosensitive material that is used for the image forming machine. In view of the above fact. Japanese Laid-Open Utility Model Publication No. 65432/1987 discloses an art in which two toner images are simultaneously formed on the electrostatic photosensitive material, the two toner images being arranged in parallel in the direction of width, while two sheet materials are simultaneously fed, being arranged in parallel in the direction of width, in order to simultaneously form the images on the two sheet materials. In order to simultaneously feed two sheet materials arranged in parallel in the direction of width, a sheet material-feeding cassette having two sheet material-holding means arranged in parallel in the direction of width is loaded onto the image forming machine, so that the sheet materials are simultaneously fed piece by one piece from each of the two sheet material-holding means.

However, the two sheet materials that are fed being arranged in parallel do not always have a predetermined size, i.e., predetermined width (size in a direction at right angle with the feeding direction) and predetermined length (size in the feeding direction). As is widely known among people skilled in the art, for instance, there are available regular envelopes and post cards having several kinds of size, i.e.. having different widths and/or lengths. In the sheet material-feeding cassette disclosed in the above Japanese Laid-Open Utility Model Publication No. 65432/1987, the two sheet material-holding means arranged in parallel can be adapted to sheet materials of a single size only. To deal with sheet materials having several types of sizes, therefore, it is necessary to provide several kinds of sheet material-feeding cassettes in each of which the two sheet material-holding means are arranged in parallel.

Furthermore, the following problems are involved not only with the sheet material-feeding cassette in which two sheet material-holding means are arranged in parallel but also by a sheet material-feeding cassette that has a single sheet material-holding means.

The sheet material-holding means usually has a placing member of which the front portion is so mounted as to at least move up and down, and a resilient urging means that resiliently urges the front portion of the placing member upwards. The sheet materials are stacked one upon the other and are held in the sheet material-holding means, while at least the front portions thereof are placed on the placing member. When the sheet material-feeding cassette is fitted in a required position of the forming machine, the front portion of the sheet material upwardly urged by the resilient urging action of the resiliently urging means is pressed onto a feeding roller arranged in the image forming machine, and the sheet material at the uppermost position is fed from the sheet material-holding means with the rotation of the feeding roller. For instance, a plurality of Western-style envelopes may be stacked one upon the other with the so-called seal piece on the back surface being arranged on the same side, and may be held in the sheet material-holding means. Due to the existence of the seal pieces, however, the thickness of the Western-style envelopes that are stacked varies to a considerable degree in the direction of width, and the side on which the seal pieces exist becomes considerably thicker than the other side. Therefore, though one side of the Western-style envelope at the uppermost position may be pressed onto the feeding roller considerably strongly, the other side thereof is relatively weakly pressed onto the feeding roller or is not pressed onto the feeding roller and is positioned slightly separately downwards; i.e., an unbalanced condition develops in the direction of width. When the unbalanced condition is formed in the direction of width, as will be easily understood, the Western-style envelope fed with the rotation of the feeding roller is tilted to one side. i.e.. the envelop is fed at a slant.

It has further been empirically known that even when the sheet materials stacked and held in the sheet material-holding means have a uniform thickness, the sheet materials are apt to be fed at a slant due to curving in the direction of width when the front portions of the sheet materials are curved in the direction of width.

SUMMARY OF THE INVENTION

A first object of the present invention is to provide a cassette for feeding sheet materials in which two sheet material-holding means are arranged in parallel, wherein the holding width and/or the length of the sheet material-holding means, is made adjustable suitably depending upon the width and/or the length of the sheet materials that are to be held, such that the cassette can be adapted to various sizes of sheet materials having different widths and/or lengths.

A second object of the present invention is to provide a cassette for feeding sheet materials in which two sheet material-holding means are arranged in parallel, wherein the holding width and/or the length of the sheet material-holding means can be adjusted very easily and quickly depending upon the widths and/or the lengths of the sheet materials that are to be held.

A third object of the present invention is to provide a cassette for feeding sheet materials in which two sheet material-holding means are arranged in parallel, wherein the holding width and/or the length of the sheet material-holding means can be adjusted very easily and quickly depending upon the widths and/or the lengths of the sheet materials that are to be held, and the adjusted conditions are maintained sufficiently reliably.

Furthermore, a fourth object of the present invention is to provide an improved cassette for feeding sheet materials which enables the sheet material at the uppermost position to be sufficiently uniformly pressed in the direction of width onto the feeding roller arranged in the image forming machine in order to avoid feeding at a slant, even when the sheet materials stacked and held in the cassette have a thickness that varies in the direction of width.

A fifth object of the present invention is to provide an improved cassette for feeding sheet materials that is capable of preventing the feeding of the sheet materials at a slant even when the front portions of the sheet materials held in the cassette are curved in the direction of width.

In order to achieve the first object of the present invention, each of the sheet material-holding means arranged in parallel is provided with a pair of width restriction members constituted by the width restriction members of the one side and the other side, of which the positions can be freely adjusted in the direction of width, and the sheet materials are held between the above pair of width restriction members. Furthermore, each of the sheet material-holding means arranged in parallel is provided with a rear end restriction member of which the position can be freely adjusted in the feeding direction, and the sheet materials are held in front of the rear end restriction member.

In order to achieve the above second object, the width restriction members on one side of each of the sheet material-holding means are coupled to each other so as to be moved as a unitary structure in the direction of width, and the width restriction members of the other side of each of the sheet material-holding means are coupled to each other, too, so as to be moved as a unitary structure in the direction of width. Moreover, the width restriction members of the one side and the width restriction members of the other side are coupled to each other so as to be moved in synchronism with each other in a direction to approach each other or to separate away from each other. Furthermore, the rear end restriction members of each of the sheet material-holding means are coupled to each other so as to be moved as a unitary structure in the feeding direction.

In order to achieve the above third object of the present invention, there is provided a brake means for suppressing the movement in the direction of width of the width restriction members of the one side and the other side. The brake means includes a plurality of brake members arranged in relation to the width restriction members of the one side and of the other side and a single operation member coupled to the plurality of brake members. Furthermore, the rear end restriction members of each of the sheet material-holding means are coupled to each other through a coupling member that extends in the direction of width, and the coupling member is provided with an operation member at a central portion in the direction of width thereof, and a locking means is provided to releasably lock the operation member from moving in the feeding direction. The locking means includes many engageable pawls arranged in the feeding direction and an engaging pawl formed on the operation member. The operation member is mounted on the coupling member to move in a predetermined direction and is provided with a resiliently urging means which resiliently urges the operation member in a direction to bring the engaging pawl into engagement with an engageable pawl.

In order to achieve the above fourth object of the present invention, furthermore, at least the front portion of the placing member arranged in the sheet material-holding means is allowed to have locally different heights. Preferably, the placing member is constituted by a rear placing plate that is mounted to turn on a swing axis extending in the direction of width along the rear edge and a front placing plate that is mounted on the rear placing plate to turn on a swing axis extending in the feeding direction.

In order to achieve the above fifth object of the present invention, the width restriction members of the one side and the other side of the sheet material-holding means have at their front ends guide portions that extend upwardly and frontwardly beyond the front end of the sheet material placed on the placing member.

In the cassette for feeding sheet materials of the present invention, it is possible to suitably the positions of the pair of width restriction members in the direction of width, i.e., to adjust the positions of the width restriction members of the one side and the other side and/or the position of the rear end restriction member of the sheet material-holding means in the feeding direction depending upon the width and/or the length of the sheet materials to be held, thereby making it possible to cope with a variety of sheet materials having dissimilar widths and/or lengths.

When the width restriction members of the one side and the other side are coupled to each other as required, their positions in the direction of width can be adjusted by manually moving only one of them whereby the adjustment of the two width restriction members can be made very easily and quickly. When the rear end restriction members of the sheet material-holding means are coupled to each other, their positions in the feeding direction can also be simultaneously adjusted very easily and quickly.

Owing to the suppressing action of the brake means, the pair of width restriction members are very reliably maintained at the adjusted positions. Owing to the locking action of the locking means, furthermore, the rear end restriction members are also very reliably maintained at the adjusted positions.

When the thickness of the sheet materials that are held in a stacked form varies in the direction of width, at least the front portion of the placing member on which are placed at least the front portions of the sheet materials is allowed to have at least locally different heights to compensate for a change in the thickness of the sheet materials in the direction of width. Therefore, the sheet material at the uppermost position is pressed onto the feeding roller in the direction of width very uniformly, and feeding at a slant is avoided.

Even when the front portions of the sheet materials held in the sheet material-holding means are curved in the direction of width, the sheet material that is fed is forcibly guided upwardly and forwardly due to the action of the guide member. The above forcibly guiding operation in the upward and forward directions serves fully to eliminate the feeding at a slant caused by curving in the direction of width.

DETAILED DESCRIPTION OF PREFERRED EMBODIMENTS

A preferred embodiment of a cassette for feeding sheet materials constituted according to the present invention will now be described in further detail in conjunction with the accompanying drawings.

Figure 1:
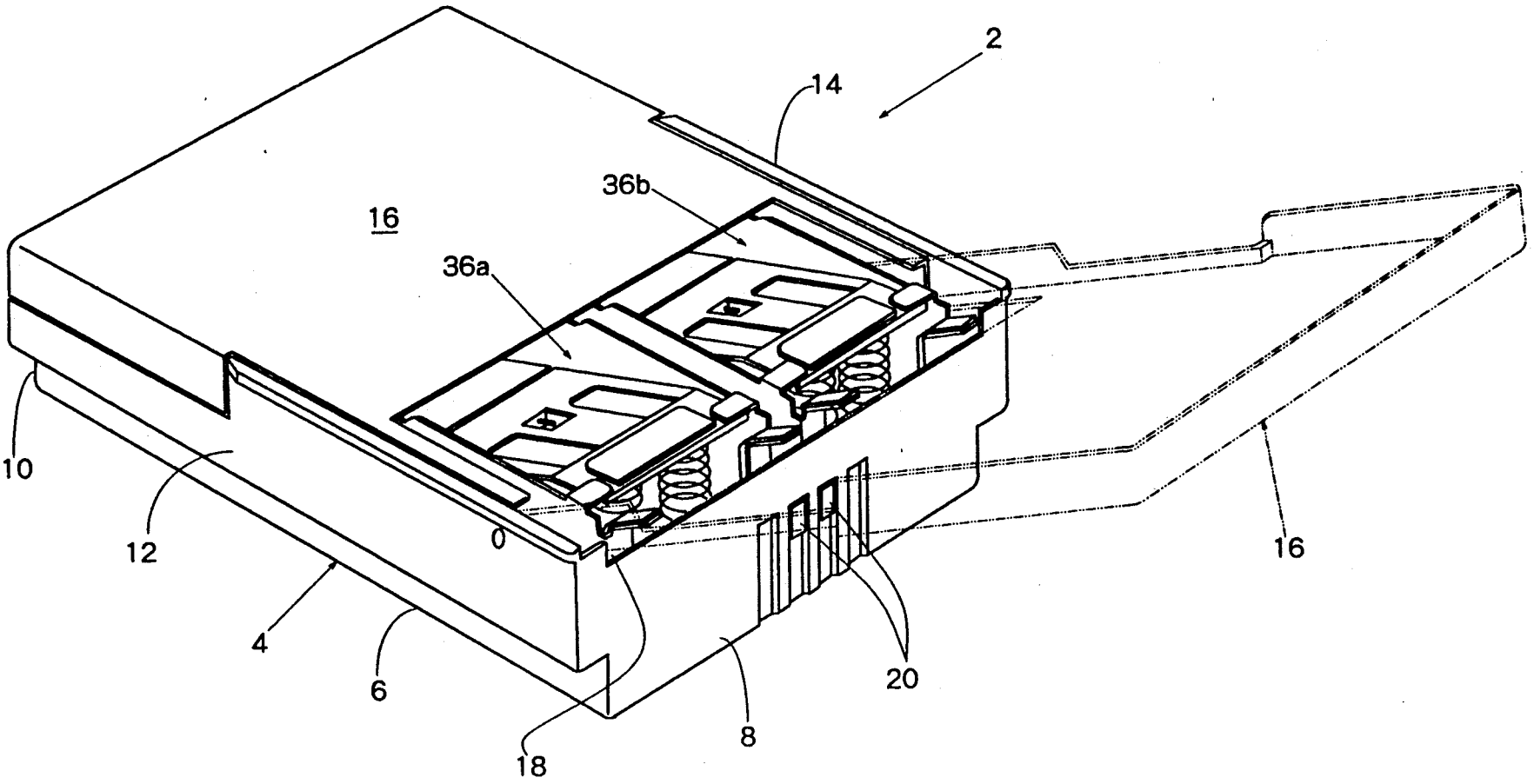
FIG. 1 is a perspective view illustrating a cassette for feeding sheet materials constituted according to a preferred embodiment of the present invention.
Figure 2:
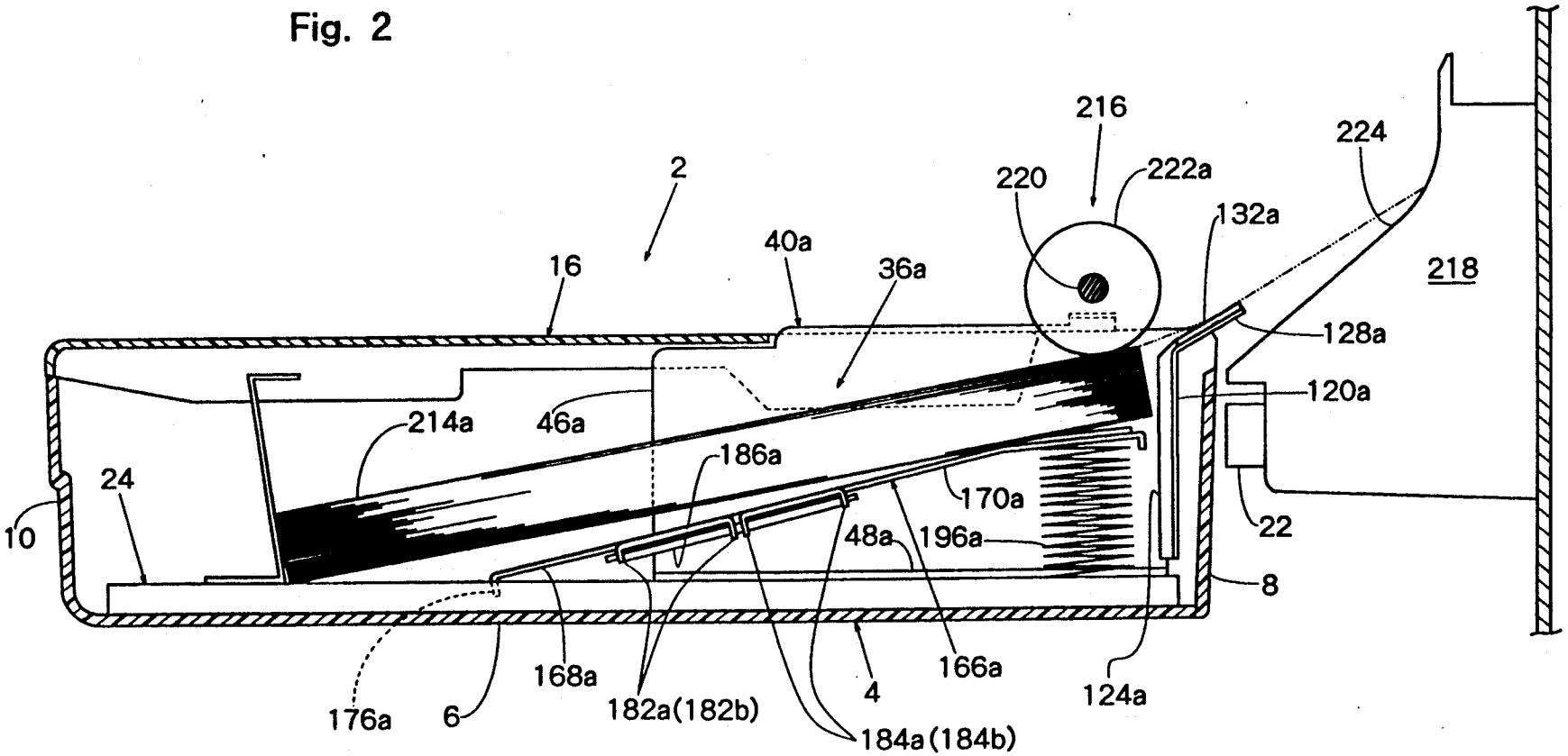
FIG. 2 is a sectional view in the feeding direction illustrating the condition where the cassette for feeding sheet materials, holding the sheet materials therein, is loaded onto the image forming machine.

With reference to FIGS. 1 and 2, the cassette for feeding sheet materials that is generally designated at 2 is equipped with a container body 4 of nearly a rectangular parallelopiped shape. The container body 4, which can be made of a suitable synthetic resin, has a bottom wall 6, as well as front and rear walls 8 and 10 and two side walls 12 and 14 that extend us from the four sides of the bottom wall 6, and has an upper surface that is entirely open. A cover member 16 is fitted to the open upper surface of the container body 4. The cover member 16, which is preferably made of a transparent or semi-transparent synthetic resin, is mounted in a known suitable manner to swing between a closed position, indicated by solid lines in FIGS. 1 and 2, and an open position, indicated by two-dot chain lines in FIG. 1. A relatively large notch is formed in the front portion of the cover member 16, and the upper front portion of the container body 4 remains open even under the condition where the cover member 16 is located at the closed position. The whole upper surface of the container body 4 is open when the cover member 16 is brought to the open position An oblong notch 18 is formed extending in the direction of width in the upper portion of the front wall 8 of the container body 4. Furthermore, two permanent magnets 20 are fastened to the central portion on the front surface of front wall 8. When the sheet material-feeding cassette 2 is loaded onto a required position of an image forming machine (FIG. illustrates only partial portions of the constituent elements) such as an electrostatic copying machine or a laser printer, a reed switch 22 disposed in the image forming machine detects the magnets 20, and thus it is detected that the cassette 2 for feeding sheet materials is loaded onto the image forming machine.

Figure 3:
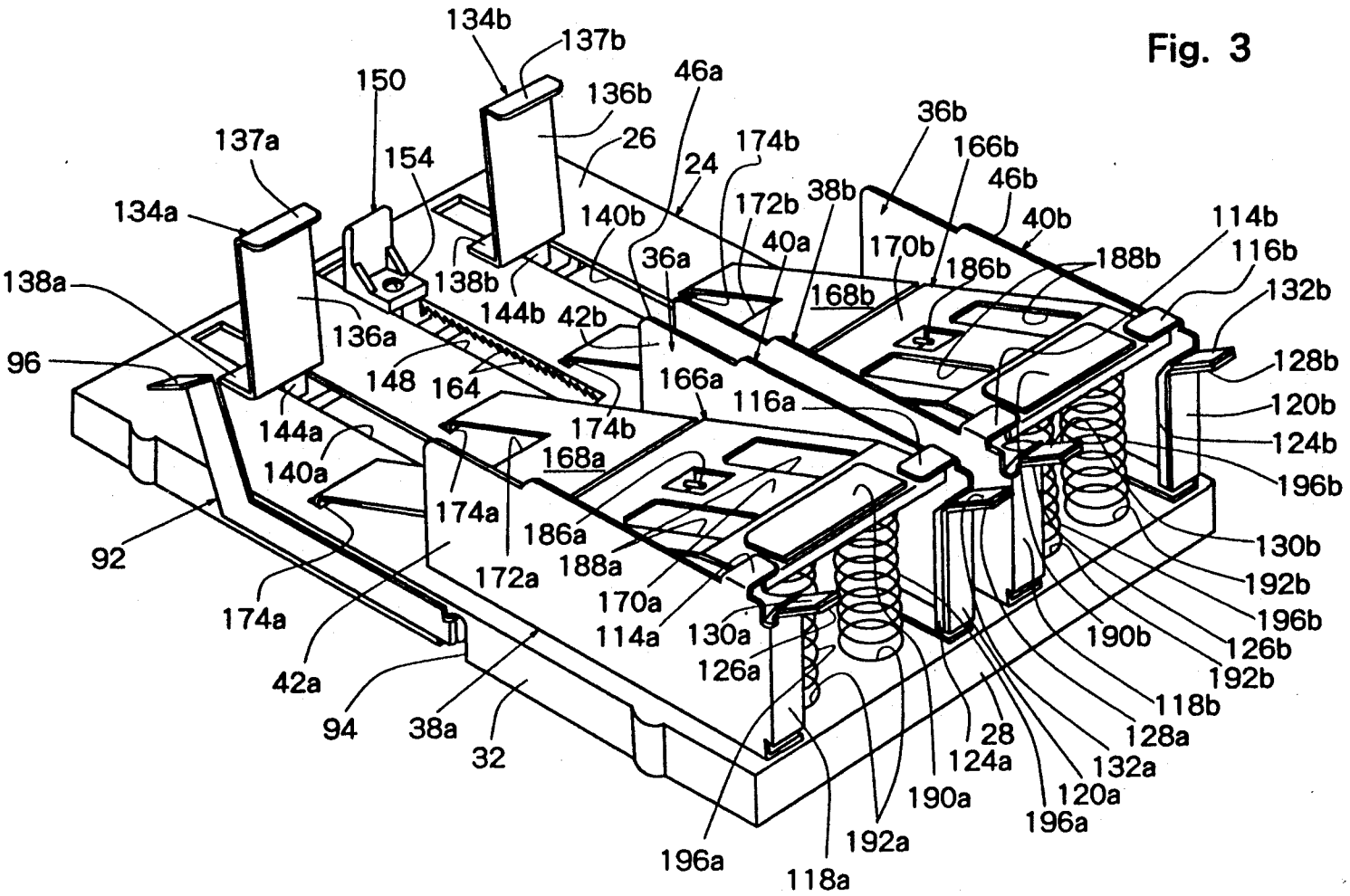
FIG. 3 is a perspective view illustrating a mechanism arranged in a container body of the cassette for feeding sheet materials.
Figure 4:
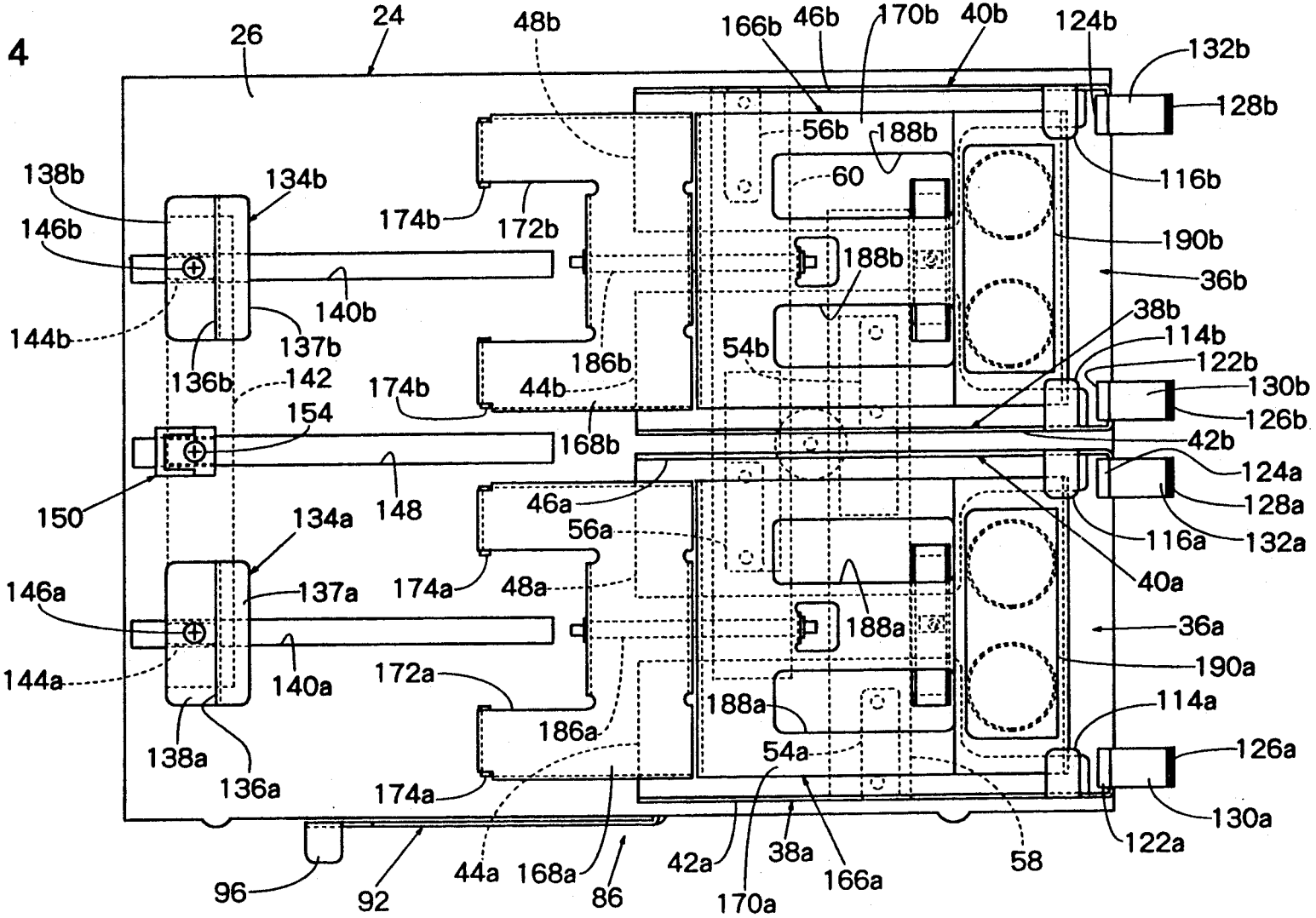
FIG. 4 is a plan view of the mechanism of FIG. 3.
Figure 5:
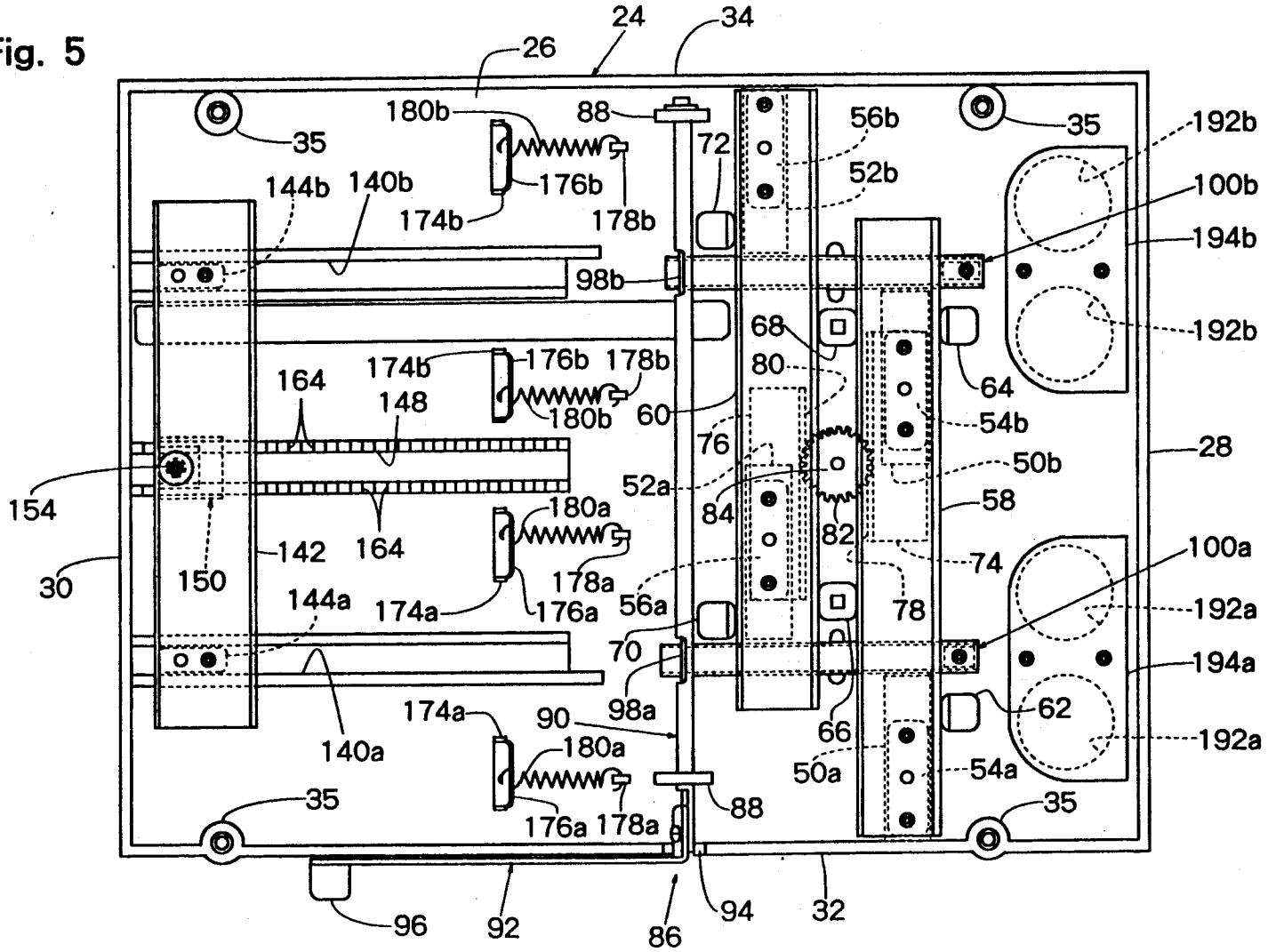
FIG. 5 is a bottom view of the mechanism of FIG. 3.

As clearly shown in FIG. 2, a support member 24 that may be made of a suitable synthetic resin is arranged on the inside of the bottom wall 6 of the container body 4. With reference to FIGS. 3 to 5 as well as FIGS. 2, the support member 24 has a flat base wall 26, front and rear hanging walls 28, 30 and two side hanging walls 32, 34 that hang down from the four sides of the base wall 26. Four coupling poles 35 (FIG. 5) are formed on the lower surface of the base wall 26, and setscrews are screwed into the coupling poles 35 from the lower side of the container body 4 via the bottom wall 6 thereof in order to secure the support member 24 to a required position on the bottom wall 6 of the container body 4.

Two sheet material-holding means 36*a* and 36*b* are provided on the base wall 26 of the support member 24, the sheet material-holding means 36*a* and 36*b* being arranged in parallel in the direction of width (direction perpendicular to the surface of the paper in FIG. 2, or up-and-down direction in FIGS. 4 and 5). The sheet material-holding means 36*a* and 36*b* include pairs of width restriction members i.e., width restriction members 38*a* and 38*b* of the one side and width restriction members 40*a* and 40*b* of the other side that are arranged, maintaining a distance. in the direction of width. The width restriction members 38*a* and 38*b* on the one side have restriction portions 42*a* and 42*b* that extend substantially perpendicularly to the base wall 26 of the support member 24, as well as base portions 44*a* and 44*b* that protrude from the lower ends of the restriction portions 42*a* and 42*b* toward the inside in the direction of width (upwardly in FIGS. 4 and 5) along the base wall 26 of support member 24. Similarly, the width restriction members 40*a* and 40*b* on the other side have restriction portions 46*a* and 46*b* that extend substantially perpendicularly to the base wall 26 of the support member 24, as well as base portions 48*a* and 48*b* that protrude from the lower ends of the restriction portions 46*a* and 46*b* toward the inside in the direction of width (downwardly in FIGS. 4 and 5) along the base wall 26 of support member 24. As clearly diagramed in FIG. 5, slits 50*a* and 50*b* are formed in the base wall 26 of support member 24 to correspond to the width restriction members 38a and 38b of the one side, and slits 52a and 52b are also formed to correspond to the width restriction members 40a and 40b of the other side. The slits 50a, 50b, 52a and 52b extend in an oblong shape in the direction of width. Blocks 54a and 54b positioned in the slits 50a and 50b are secured to the lower surfaces of base portions 44a and 44b of width restriction members 38a and 38b of the one side and, similarly, blocks 56a and 56b positioned in the slits 52a and 52b are secured to the lower surfaces of base portions 48a and 48b of width restriction members 40a and 40b of the other side. The blocks 54a, 54b, 56a and 56b have sizes in the direction of width which are smaller than the sizes of the slits 50a, 50b, 52a and 52b in the direction of width. Thus, the width restriction members 38a and 38b of the one side are mounted on the base wall 26 of the support member 24 maintaining a freedom of movement in the direction of width between a position at which the ends of blocks 54a and 54b in the direction of width come in contact with the ends of slits 50a and 50b in the direction of width and a position at which the other ends of blocks 54a and 54b in the direction of width come in contact with the other ends of slits 50a and 50b in the direction of width. Similarly, the width restriction members 40a and 40b on the other side are also mounted on the base wall 26 of support member 24 maintaining a freedom of movement in the direction of width between a position at which the ends of blocks 56a and 56b in the direction of width come in contact with the ends of slits 52a and 52b in the direction of width and a position at which the other ends of blocks 56a and 56b in the direction of width come in contact with the other ends of slits 52a and 52b in the direction of width.

With reference to FIGS. 4 and 5, two coupling members extending in the direction of width are arranged. i.e., a coupling member 58 of the one side and a coupling member 60 of the other side are arranged on the lower surface of the base wall 26 of support member 24. To the coupling member 58 on the one side are coupled, by using setscrews, the blocks 54a and 54b that have been secured to the width restriction members 38a and 38b of the one side. Therefore, the width restriction member 38a on the one side of the sheet material-holding means 36a and the width restriction member 38b on one side of the sheet material-holding means 36b are coupled together via the coupling member 58 of the one side, and move as a unitary structure in the direction of width. Similarly, to the coupling member 60 on the other side are coupled, by using setscrews, the blocks 56a and 56b that have been secured to the width restriction members 40a and 40b of the other side. Therefore, the width restriction member 40a of the other side of the sheet material-holding means 36a and the width restriction member 40b of the other side of the sheet material-holding means 36b are coupled together via the coupling member 60 of the other side, and move as a unitary structure in the direction of width. Six guide protuberances 62, 64, 66, 68, 70 and 72 are formed on the lower surface of base wall 26 of the support member 24. The coupling member 58 of the one side is positioned between the guide protuberances 62, 64 and the guide protuberances 66, 68, and is prevented by the action of these guide protuberances 62, 64, 66 and 68 from moving in the feeding direction (right-and-left direction in FIGS. 4 and 5) but is guided to move in the direction of width (up-and-down direction in FIGS. 4 and 5). Similarly, the coupling member 60 of the other side is positioned between the guide protuberances 66, 68 and the guide protuberances 70, 72, and is prevented by the action of these guide protuberances 66, 68, 70 and 72 from moving in the feeding direction, but is guided to move in the direction of width.

Rack members 74 and 76 extending in the direction of width are secured to the upper surface of the coupling member 58 of the one side and to that of the coupling member 60 of the other side, and racks 78 and 80 are engraved in the facing edges of the rack members 74 and 76. On the lower surface of the base wall 26 of the support member 24 is rotatably mounted a pinion gear 84 having pinion 82 engraved in the peripheral surface thereof. The pinion 82 of the pinion gear 84 is brought into engagement with the racks 78 and 80 engraved in the rack members 74 and 76. Therefore, the coupling member 58 of the one side and the coupling member 60 of the other side are coupled to each other via the rack member 74, pinion gear 84 and rack member 76. When the coupling member 58 of the one side is moved toward the other side in the direction of width (upwardly in FIG. 4) by a predetermined distance, the coupling member 60 of the other side is moved in the opposite direction. i.e., toward the one side in the direction of width (downwardly in FIG. 4) by substantially the same distance. Therefore, if the width restriction member 38a of the one side is moved in the direction of width in order to adjust the distance in the direction of width between the pair of width restriction members 38a and 40a of the sheet material-holding means 36a, the width restriction member 40a of the other side is moved toward the opposite side in the direction of width. Therefore, the width restriction member 38a of the one side and the width restriction member 40a of the other side move toward directions to approach each other or to separate away from each other in synchronism without changing the center therebetween in the direction of width. At the same time, furthermore, the width restriction member 38b of the one side and the width restriction member 40b of the other side in the other sheet material-holding means 36b can also be moved toward the directions to approach each other or to separate away from each other in synchronism without changing the center therebetween in the direction of width. By moving any one of the four width restriction members 38a, 38b, 40a and 40b in the direction of width, therefore, the distance in the direction of width between the pair of width restriction members 38a and 40a of the sheet material-holding means 36a and the distance in the direction of width between the pair of width restriction members 38b and 40b of the sheet material-holding means 36b can be correspondingly adjusted very easily and quickly. If desired, any one of the four width restriction members 38a, 38b, 40a and 40b is provided with an operation member (not shown), and by operating the operation member, it is possible to adjust the distance in the direction of width between the pair of width restriction members 38a and 40a and the distance in the direction width between the pair of width restriction 38b and 40b.

The support member 24 is provided with a brake means 86 which stops the width restriction members 38a, 38b, 40a and 40b at desired positions. With reference to FIG. 5, support pieces 88 are formed on the lower surface of the base wall 26 of support member 24 at nearly the center in the feeding direction on both sides in the direction of width. A rod 90, extending in the direction of width, is rotatably fitted to the support pieces 88. An end of an operation member 92 is coupled to an end (lower end in FIG. 5) of the rod 90. As will be clearly comprehended with reference to FIG. 3 and FIG. 5, the operation member 92 outwardly extends in the direction of width starting from the end at which it is coupled to the rod 90, passing through a notch 94 formed in the hanging wall 32 of the support member 24, then extends nearly in an L-shape rearwardly in the feeding direction, and has a grip piece 96 formed at a free end thereof. Further, with reference to FIG. 5 as well as FIGS. 6 to 9, the rod 90 has a semicircular shape in cross section (the rod 90 has mostly a circular shape in cross section) at two portions. i.e., at a portion 98a, that is centered between the pair of width restriction members 38a and 40a in the direction of width, and at a portion 98b, that is centered between the pair of width restriction members 38b and 40b in the direction of width. Swing members 100a and 100b are arranged in relation to the above portions 98a and 98b of the rod 90. A pair of protuberances 102a and 102b are formed at middle portions in the lengthwise direction of the swing members 100a and 100b that extend in the feeding direction to come in contact with the lower surface of the base wall 26 of support member 24. The rear ends of the swing members 100a and 100b are positioned on the above portions 98a and 98b of the rod 90. To the front ends of the swing members 100a and 100b are secured coupling pieces 106a and 106b that upwardly extend, passing through openings 104a and 104b formed in the base wall 26 of support member 24. Pushing pieces 108a and 108b that extend in the direction of width are secured to the upper ends of the coupling pieces 106a and 106b. Brake members 110a, 112a, 110b and 112b, that can be made of a material having a large coefficient of friction such as a synthetic rubber, are stuck to the lower surfaces of the pushing pieces 108a and 108b at both ends in the direction of width. The brake members 110a, 112a and 110b, 112b are positioned over the base portions 44a, 48a and 44b, 48b of the width restriction members 38a, 40a and 38b, 40b (the brake members 110a, 112a and 110b, 112b remain positioned over the base portions 44a, 48a and 44b, 48b even when the width restriction members 38a, 40a and 38b, 40b are moved in the direction of width).

Figure 6:
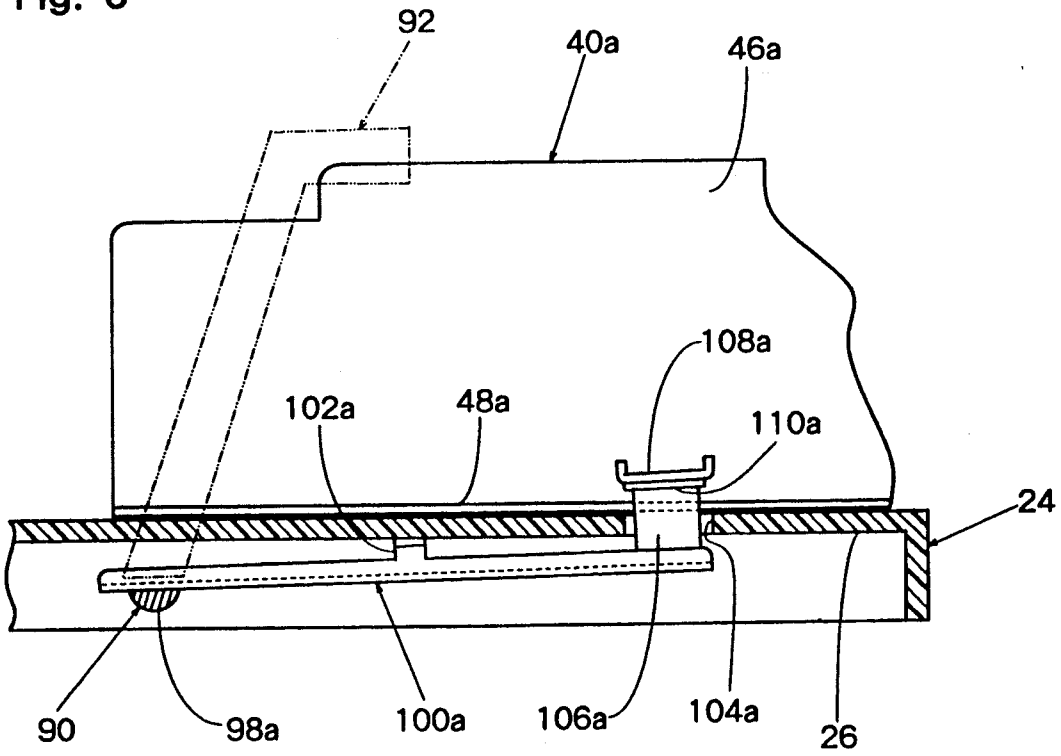
FIG. 6 is a partial sectional view in the feeding direction showing width restriction members in the cassette for feeding sheet materials of FIG. 1 and a brake means disposed in relation thereto under the condition where the brake means is not acting.
Figure 7:
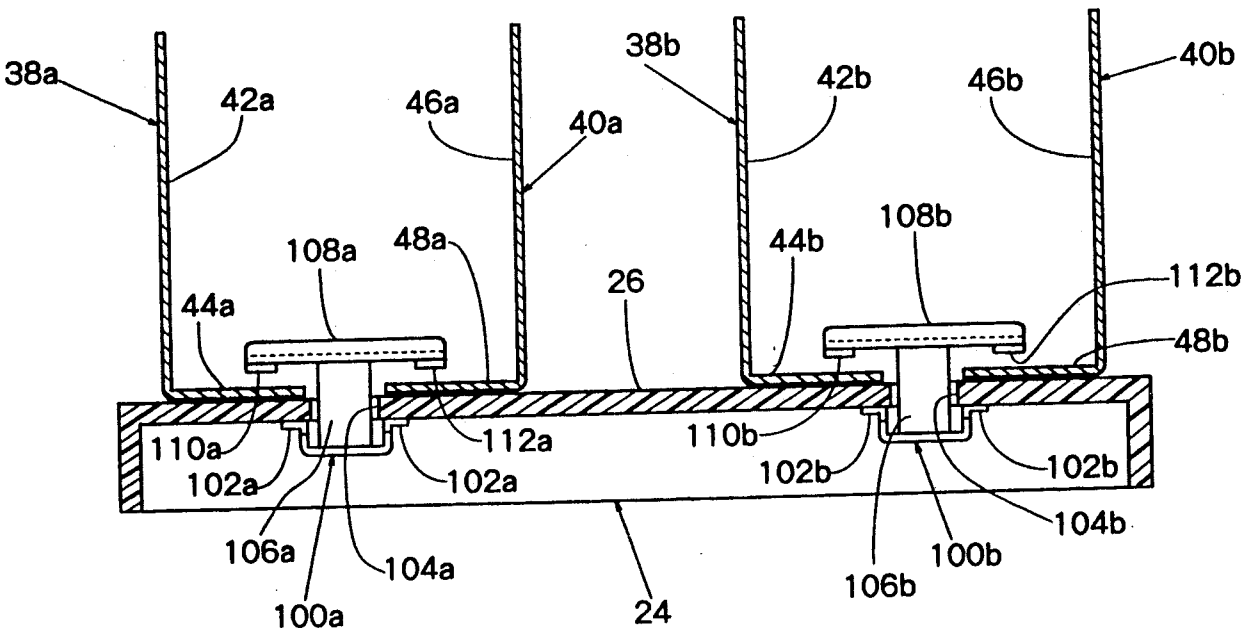
FIG. 7 is a partial sectional view in the direction of width showing width restriction members in the cassette for feeding sheet materials of FIG. 1 and a brake means disposed in relation thereto under the condition where the brake means is not acting.
Figure 8:
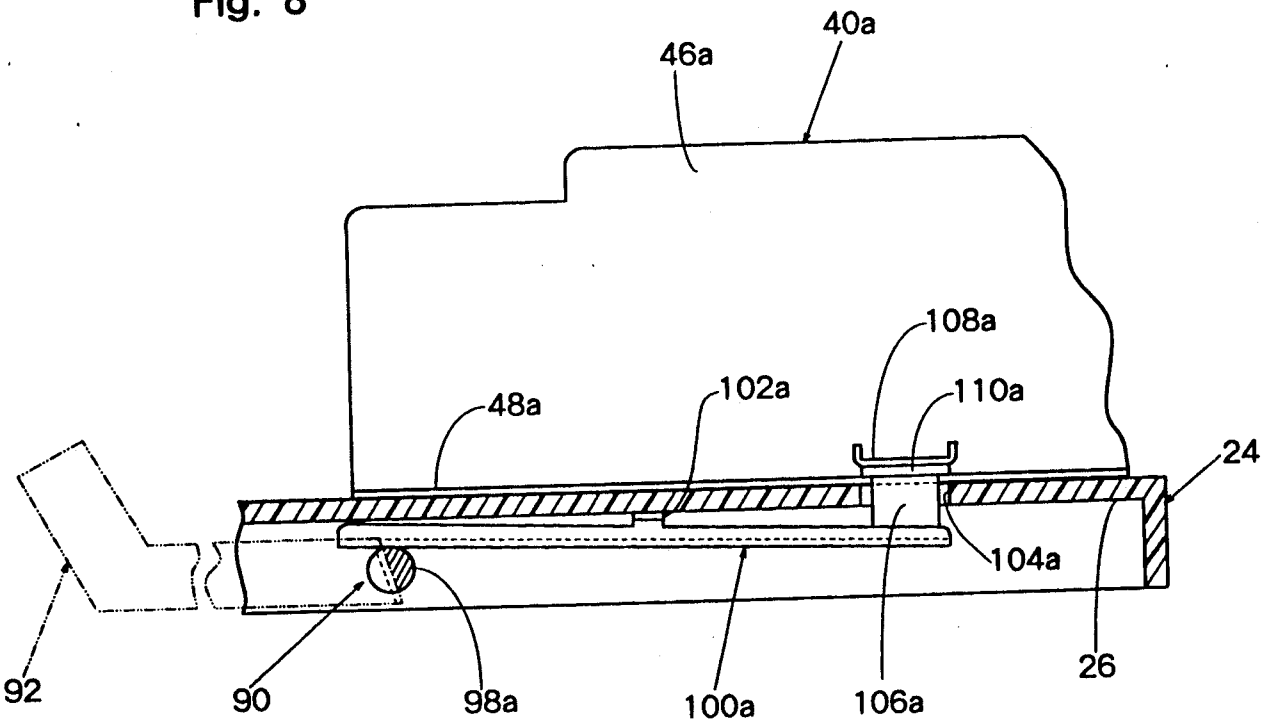
FIG. 8 is a partial sectional view in the feeding direction showing width restriction members in the cassette for feeding sheet materials of FIG. 1 and a brake means disposed in relation thereto under the condition where the brake means is acting.
Figure 9:
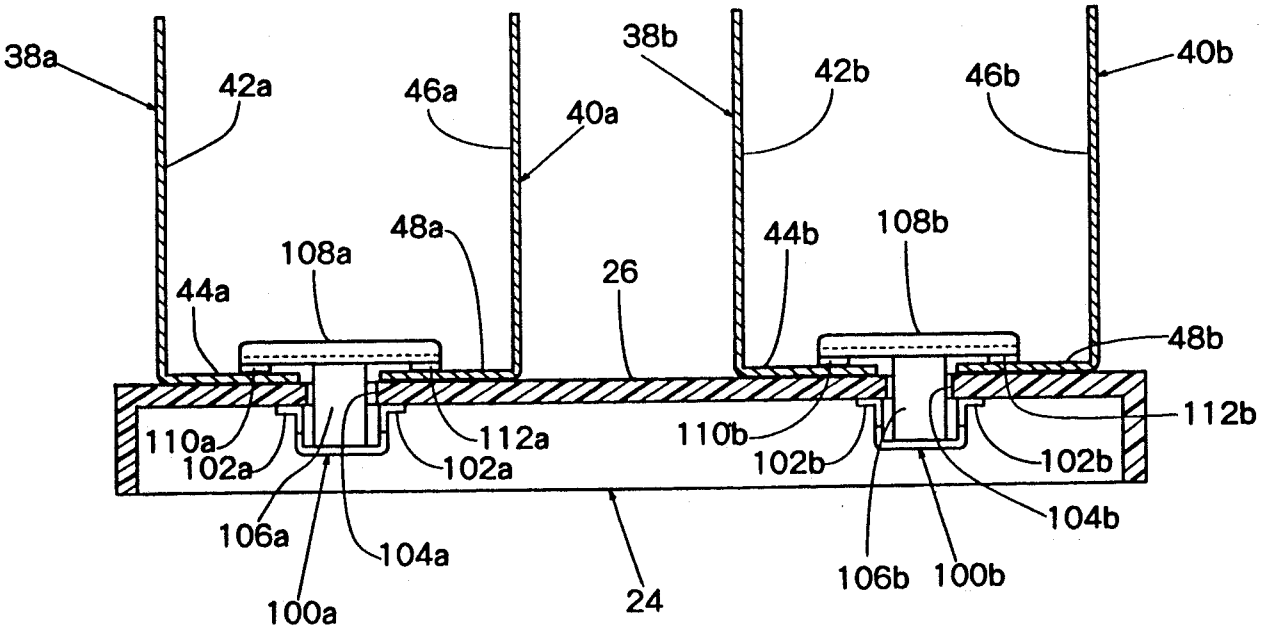
FIG. 9 is a partial sectional view in the direction of width showing width restriction members in the cassette for feeding sheet materials of FIG. 1 and a brake means disposed in relation thereto under the condition whe:e the brake means is acting.
Figure 10:
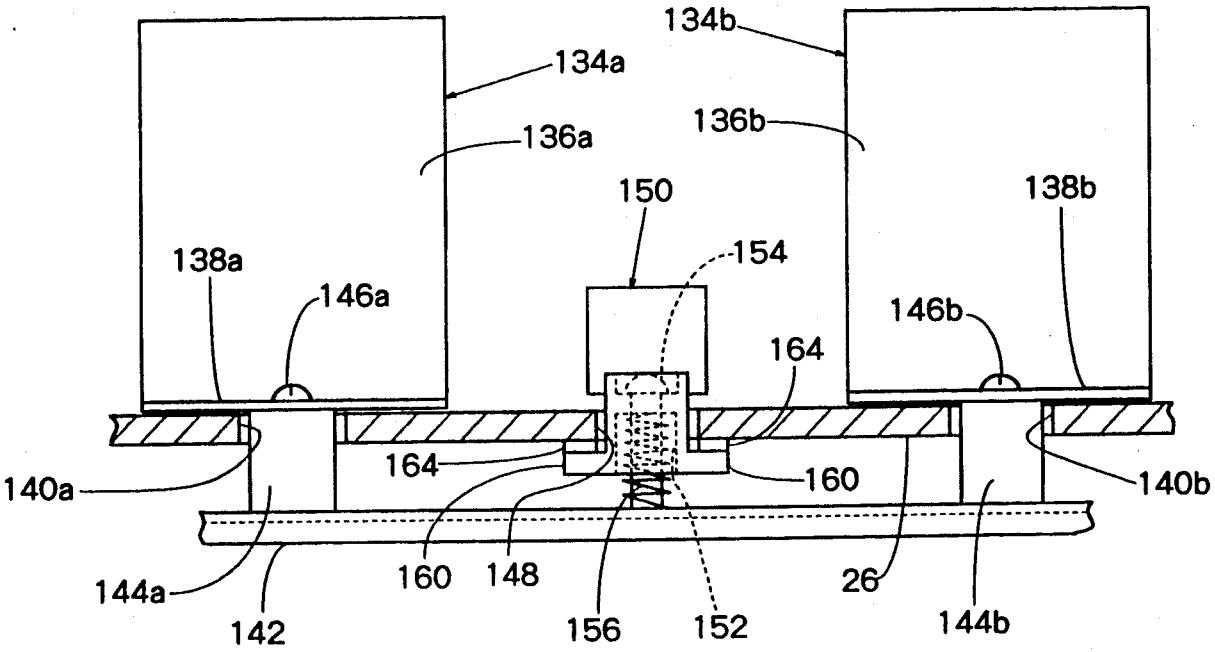
FIG. 10 is a partial sectional view in the direction of width showing rear end restriction members in the cassette for feeding sheet materials of FIG. 1, an operation member disposed in relation thereto, and a locking means.
Figure 11:
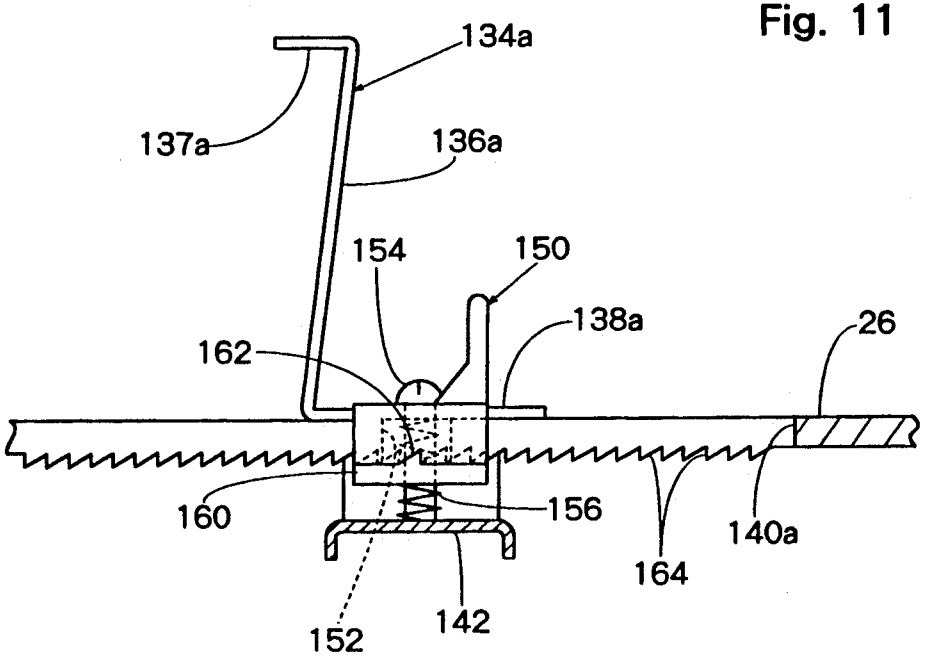
FIG. 11 is a partial sectional view in the feeding direction showing rear end restriction members in the cassette for feeding sheet materials of FIG. 1, an operation member disposed in relation thereto, and a locking means.
Figure 12:
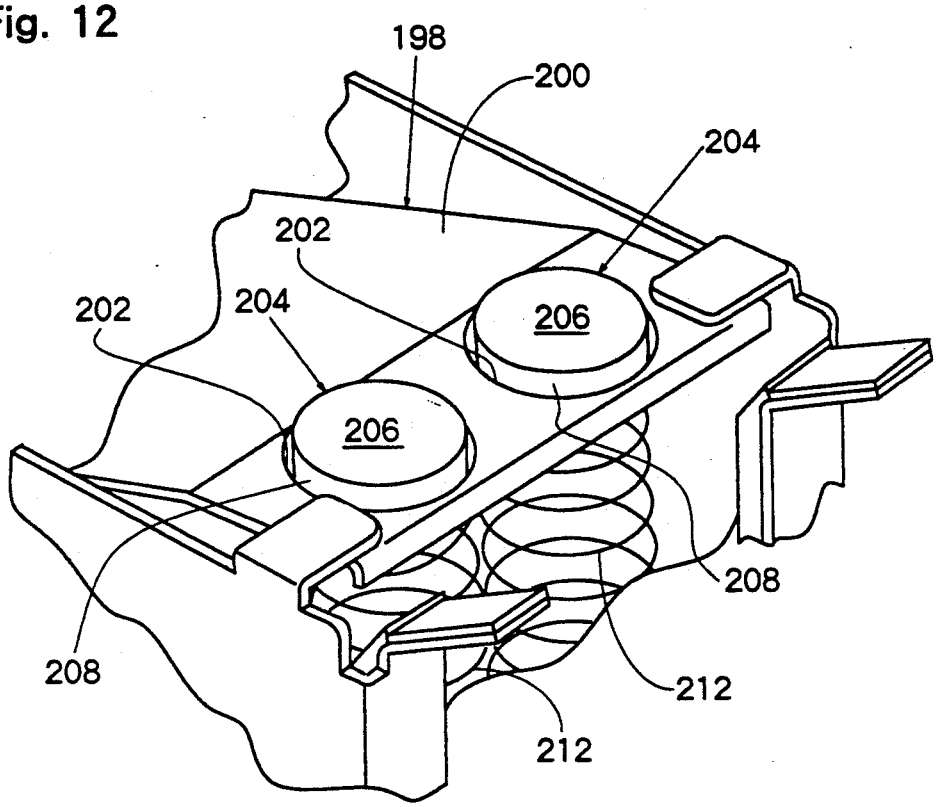
FIG. 12 is a partial perspective view illustrating a modified embodiment of a placing member.
Figure 13:
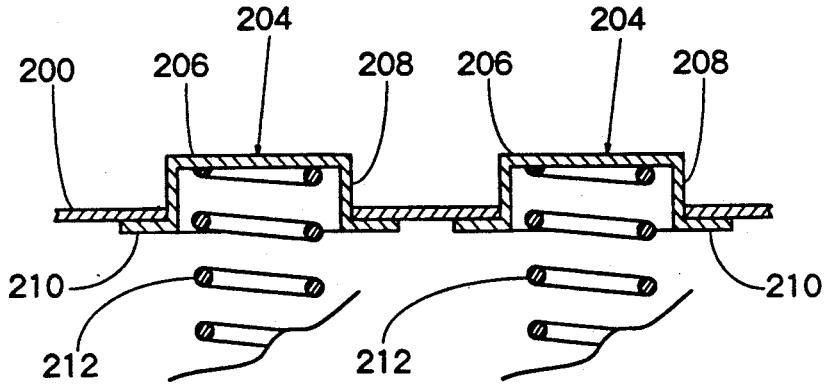
FIG. 13 is a partial sectional view of the placing member of FIG. 12.

In the above-mentioned brake means 86, when the operation member 92 is located at the non-acting position shown in FIGS. 6 and 7, the flat surface of the semi-circular shape at the above portions 98a and 98b of the rod 90 is facing upwards. Under the above condition, the swing members 100a and 100b are tilted upwardly from the rear end toward the front end thereof due to their own weights and the weight of the rod 90, and the rear ends of the swing members 100a and 100b are supported on the flat surfaces of the portions 98a and 98b of the rod 90. The brake members 110a, 112a and 110b, 112b that are stuck to the lower surfaces of the pushing pieces 108a and 108b are located at the non-acting positions over the base portions 44a, 48a and 44b, 48b of the width restriction members 38a, 40a and 38b, 40b. Therefore, the width restriction members 38a, 40a and 38b, 40b are allowed to move freely in the direction of width. When the grip piece 96 of the operation member 92 is lowered to the acting position shown in FIGS. 8 and 9, the rod 90 is rotated by about 105 degrees so that the flat surfaces of the semicircular shape at the portions 98a and 98b are backwardly faced, and the rear ends of the swing members 100a and 100b are raised. Therefore, the swing members 100a and 100b are swung in the clockwise direction in FIGS. 6 and 8 with the pair of protuberances 102a and 102b which are in contact with the lower surface of the base wall 26 of support member 24 and serve as fulcrums, whereby the front ends of the swing members 100a and 100b are lowered. Thus, the brake members 110a, 112a and 110b, 112b are lowered to the acting positions and are pressed onto the base portions 44a, 48a and 44b, 48b of the width restriction members 38a, 40a and 38b, 40b. Under the above condition, the swing members 110a, 110b, the rod 90, and the operation member 92 are maintained under the condition shown in FIGS. 8 and 9 due to the mutual pushing forces between the rear ends of the swing members 110a, 110b and the portions 98a, 98b of the rod 90, whereby the brake members 110a, 112a and 110b, 112b are maintained at the above-mentioned acting positions. Thus, the width restriction members 38a, 40a and 38b, 40b are suppressed by the brake members 110a, 112a and 110b, 112b from moving in the direction of width, and are reliably maintained at the desired positions. If desired, there may be provided a resiliently urging means (not shown) that acts on the operation member 92, the rod 90 or the swing members 100a and 100b to resiliently urge the brake members 110a, 112a and 110b, 112b to the above acting positions, or there may be provided a locking means (not shown) to lock them at the above acting position.

With reference to FIGS. 3 and 4, limit protuberances 114a and 114b, inwardly (upwardly in FIG. 4) protruding in the direction of width, are formed at the upper front edge portions of restriction portions 42a and 42b of width restriction members 38a and 38b of the one side. Similarly, limit protuberances 116a and 116b, inwardly (downwardly in FIG. 4) protruding in the direction of width, are formed at the upper front portions of restriction portions 46a and 46b of width restriction members 40a and 40b of the other side. Moreover, front restriction portions 118a and 118b are formed at the front ends of width restriction members 38a and 38b of the one side to inwardly extend in the direction of width and, similarly, front restriction portions 120a and 120b are formed at the front ends of width restriction members 40a and 40b of the other side to inwardly extend in the direction of width. Front restriction pieces 122a, 122b, and 124a, 124b that are preferably made of a suitable synthetic resin, are stuck to the rear surfaces of the front restriction portions 118a, 118b and 120a, 120b (width restriction members 38a, 38b and 40a, 40b are preferably made of a metal plate). Furthermore, guide portions 126a, 126b and 128a, 128b that extend upwardly and forwardly are formed at the upper ends of the front restriction portions 118a, 118b and 120a, 120b as a unitary structure, and friction members 130a, 130b and 132a, 132b, which are preferably composed of, for example, a cork powder-containing synthetic rubber having a large coefficient of friction, are stuck to the upper surfaces of the guide portions 126a, 126b and 128a, 128b. As will be clearly understood from FIG. 2, the upper end surfaces of the front restriction pieces 122a, 122b and 124a, 124b are upwardly tilted toward the front, and are smoothly connected to the upper surfaces of the friction members 130a, 130b and 132a, 132b.

With reference to FIGS, 10 and 11 as well as FIGS. 3 to 5, each of the sheet material-holding means 36a and 36b includes rear end restriction members 134a and 134b that are mounted to freely move in the feeding direction. Each of the rear end restriction members 134a and 134b has restriction portions 136a and 136b that extend nearly perpendicularly to the base wall 26 of support member 24, protruded portions 137a and 137b that forwardly protrude from the upper ends of the restriction portions 136a and 136b, and base portions 138a and 138b that rearwardly extend from the lower ends of the restriction portions 136a and 136b along the base wall 26 of support member 24. Slits 140a and 140b are formed in the rear portion of base wall 26 of the support member 24 to correspond to the rear end restriction members 134a and 134b, respectively. The slits 140a and 140b extend in the feeding direction passing the center between the pair of width restriction members 38a and 40a in the direction of width and the center between the pair of width restriction members 38b and 40b in the direction of width. A coupling member 142 extending in the direction of width is arranged under the base wall 26 of support member 24. The base portions 138a and 138b of rear end restriction members 134a and 134b are coupled to the coupling member 142 via slidable blocks 144a and 144b. In further detail, setscrews 146a and 146b are screwed into the coupling member 142 penetrating through the base portions 138a and 138b of rear end restriction members 134a and 134b and through the slidable blocks 144a and 144b, so that the rear end restriction members 134a and 134b are coupled to the coupling member 142 as a unitary structure. The slidable blocks 144a and 144b are held in the above slits 140a and 140b so as to freely slide in the feeding direction. Therefore, the rear end restriction members 134a and 134b freely move as a unitary structure in the feeding direction.

Another slit 148 is formed in the base wall 26 of support member between the above slits 140a and 140b. An operation member 150 is disposed to move along the slit 148 that extends in the feeding direction. The operation member 150 has a lower portion that downwardly protrudes through the slit 148, and a blind hole 152 is formed in the lower portion to extend upwardly from the lower surface thereof. A coupling screw 154 is screwed into the coupling member 142 penetrating through the operation member 150. A resiliently urging means 156 is disposed between the coupling member 142 and the operation member 150. The resiliently urging means 156 is constituted by a coiled spring which surrounds the coupling screw 154, and is held at its upper end in the blind hole 152 and is brought at its lower end into contact with the upper surface of the coupling member 142. Thus, the operation member 150 is mounted on the coupling member 142 to move in the up-and-down direction, and is further resiliently urged upwards by the resiliently urging means 156. Protruded portions 160 are formed at the lower end of the operation member 150 to protrude toward both sides in the direction of width, and a saw-toothed engaging pawl 162 is formed on the upper surfaces of the protruded portions 160. On the other hand, many engageable pawls 164 are formed in the lower surface of base wall 26 of the support member 24 along both sides of the slit 148. The engageable pawls 164 have the shape of saw-teeth too. The operation member 150 is resiliently urged upwards by the action of the resiliently urging means 156, whereby the engaging pawls 162 are brought into engagement with any engageable pawls 164 on both sides of the slit 148. Thus, the operation member 150 is prevented from moving in the feeding direction and, hence, the rear end restriction members 134a and 134b are prevented from moving in the feeding direction. The engaging pawls 162 and the engageable pawls 164 work in cooperation together to constitute a locking means which blocks the rear end restriction members 134a and 134b from moving in the feeding direction and maintains them at required positions. When the operation member 150 is slightly lowered down against the action of the resiliently urging means 156, the engaging pawl 162 is downwardly separated away from the engageable pawl 164, and the operation member 150 is allowed to move. When the operation member 150 is moved in the feeding direction, the rear end restriction members 134a and 134b move correspondingly in the feeding direction. By so manipulating the operation member 150, it is possible to simultaneously adjust the positions of both the rear end restriction member 134a of the sheet material-holding means 36a and the rear end restriction member 134b of the sheet material-holding means 36b in the feeding direction.

With reference to FIGS. 2 to 5, the sheet material-holding means 36a and 36b are provided with placing members 166a and 166b, respectively. The placing members 166a and 166b are constituted by rear placing plates 168a, 168b and front placing plates 170a, 170b. Relatively large notches 172a and 172b are formed at the rear portions of the rear placing plates 168a and 168b at the central positions in the direction of width thereof. Slits 174a and 174b extending in the direction of width are formed in the base wall 26 of support member 24 to correspond to both sides at the rear ends of the rear placing plates 168a and 168b. Folded pieces 176a and 176b are formed, being downwardly folded, on both sides at the rear ends of the rear placing plates 168a and 168b, and are inserted in the above slits 174a and 174b. As clearly illustrated in FIG. 5, on the lower surface of base wall 26 of the support member 24 are formed engaging protrusions 178a and 178b that are positioned in front of the slits 174a and 174b, respectively. Resiliently urging means 180a and 180b, which may be tension coiled springs, are stretched between the engaging protrusions 178a and 178b and the folded pieces 176a and 176b of rear placing plates 168a and 168b. Thus, the rear placing plates 168a and 168b are mounted on the base wall 26 of the support member 24 to turn on a swing axis that extends in the direction of width along the folded pieces 176a and 176b, and are resiliently urged in the counterclockwise direction in FIG. 2 by the action of the resiliently urging means 180a and 180b.

As clearly shown in FIG. 2, two hanging pieces 182a and 182b are formed at the central portions in the direction of width of the rear placing plates 168a and 168b, maintaining a distance, in the feeding direction. Two hanging pieces 184a and 184b are further formed at central portions in the direction of width of the front placing plates 170a and 170b maintaining a distance, in the feeding direction. A coupling shaft 186a extending in the feeding direction is mounted passing through the hanging pieces 182a and 184a, and another coupling shaft 186b extending in the feeding direction is mounted passing through the hanging pieces 182b and 184b. Thus, the front placing plates 170a and 170b are mounted to the rear placing plates 168a and 168b to turn on the swing axis in the feeding direction, i.e., on the center axis of the coupling shafts 186a and 186b. Two openings 188a and 188b are formed, maintaining a distance, in the direction of width at central portions in the feeding direction of the front placing plates 170a and 170b. Front ends of the front placing plates 170a and 170*b* are tilted slightly downwards toward the front with respect to the main portions thereof, and friction members 190*a* and 190*b* made of a material, having a large coefficient of friction such as synthetic rubber, are stuck to the upper surfaces of the front ends. Two circular openings 192*a* and 192*b* are formed maintaining a distance in the base wall 26 of support member 24 in the direction of width to correspond to the front ends of the front placing plates 170*a* and 170*b*, and to the lower surface of the base wall 26 are secured receiving plates 194*a* and 194*b* located under the openings 192*a* and 192*b*. Resilient urging means 196*a* and 196*b*, constituted by compression coiled springs, are disposed in relation to the openings 192*a* and 192*b*. The resilient urging means 196*a* and 196*b* are inserted in the openings 192*a* and 192*b*, and their lower ends are brought into contact with the receiving plates 194*a* and 194*b*, and their upper ends are brought into contact with the lower surfaces of front ends of front placing plates 170*a* and 170*b*. The resilient urging means 196*a* and 196*b* resiliently urge the front ends of the front placing plates 170*a* and 170*b* upwardly, i.e.. resiliently urge the placing members 166*a* and 166*b* in the counterclockwise direction in FIG. 2. Under the condition where no sheet material is held in the sheet material-holding means 36*a* and 36*b*, both sides at the front ends of the front placing plates 170*a* and 170*b* come in contact with the limit protuberances 114*a*, 116*b* and 114*b*, 116*b* formed on the width restriction members 38*a*, 40*a* and 38*b*, 40*b*, and the placing members 166*a* and 166*b* are prevented from turning in the counterclockwise direction in FIG. 2. Under the condition where a plurality of sheet materials are held in the stacked manner in the sheet material-holding means 36*a* and 36*b* but where the cassette 2 for feeding sheet materials has not yet been loaded onto the image forming machine, the uppermost sheet materials placed on the placing members 166*a* and 166*b* come in contact with the limit protuberances 114*a*, 116*a* and 114*b*, 116*b*. so that the placing members 166*a* and 166*b* are prevented from turning in the counterclockwise direction in FIG. 2.

In the aforementioned embodiment, the placing members 166*a* and 166*b* are constituted by the rear placing plates 168*a*, 168*b* and the front placing plates 170*a*, 170*b*, and the heights of each of the front portions of the placing members 166*a* and 166*b* are made dissimilar in the direction of width as required, i.e., one side is rendered to be higher or lower than the other side since the front placing plates 170*a* and 170*b* are turned on the swing axis in the feeding direction (center axis of coupling shafts 186*a* and 186*b*). In its place, if desired, the whole placing member may be mounted to turn on the swing axis extending in the feeding direction, so that the height of the whole placing member is varied as required in the direction of width.

FIGS, 12 and 13 illustrate another modified embodiment of the placing member. In this modified embodiment, the placing member 198 includes a placing plate 200 that has two circular openings 202 formed maintaining a distance in the front end thereof in the direction of width. An ascend/descend member 204 is set in each of the circular openings 202. The ascend/descend member 204 has a circular top wall 206, a cylindrical side wall 208 that hangs down from the peripheral edge of the top wall 206, and an annular flange wall 210 that radially extends from the lower end of the side wall 208. The side wall 208 has an outer diameter which is slightly smaller than the inner diameter of the opening 202, but the flange wall 210 has an outer diameter which is slightly greater than the inner diameter of the opening 202. The upper end of the resilient urging means 212 which resiliently urges the front end of the placing member 198 upwards is brought into contact with the lower surface of the top wall 206. In this modified embodiment, when the flange wall 210 of the ascend/descend member 204 is brought in contact with the placing plate 200, the front end of the placing plate 200 is upwardly urged by the action of the resilient urging means 212. As will further be described later, when the thickness of sheet materials placed on the placing member 198 varies in the direction of width, one of the ascend/descend member 204 is slightly lowered with respect to the placing plate 200, overcoming the resilient urging action of the resilient urging means 212, and the height of front end of the placing member 198 is locally changed.

Figure 14:
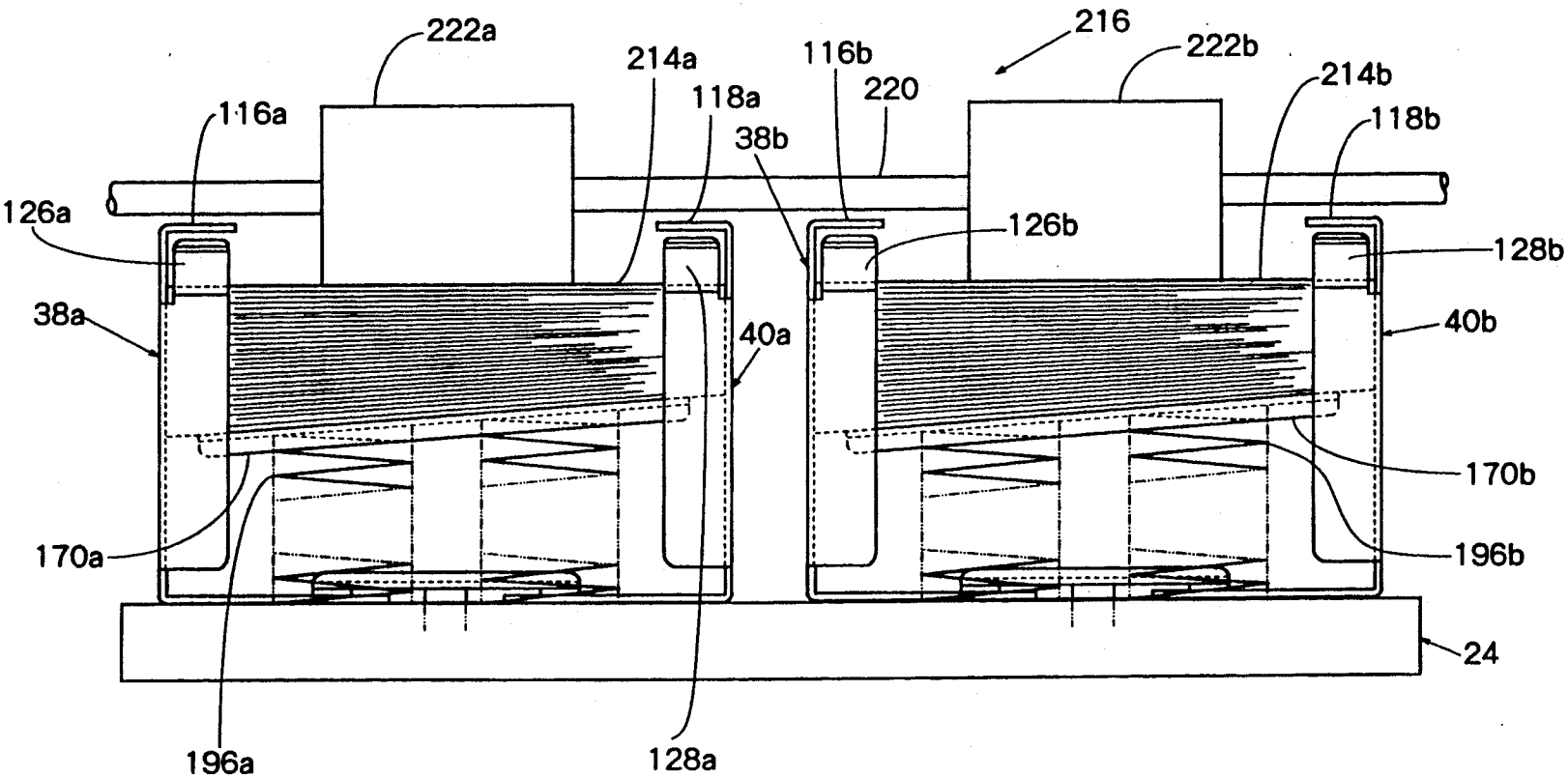
FIG. 14 is a sectional view in the direction of width showing the condition where the cassette for feeding sheet materials of FIG. 1, holding the sheet materials, is loaded onto the image forming machine.

With reference to FIGS. 1 to 3 and FIG. 14, in the cassette 2 for feeding sheet materials constituted according to the present invention, the cover member 16 is opened as indicated by two-dot chain lines in FIG, 1, and then a plurality of sheet materials 214*a* and 214*b* are held in a stacked manner in the two sheet material-holding means 36*a* and 36*b* that are arranged in parallel in the direction of width. The front portions of sheet materials 214*a* and 214*b* are placed on the placing members 166*a* and 166*b*. Therefore, the front ends of sheet materials 214*a* and 214*b* are resiliently urged upwards by the action of the resiliently urging means 196*a* and 196*b* (as well as 180*a* and 180*b*). When the sheet materials 214*a* and 214*b* are to be held in the sheet material-holding means 36*a* and 36*b*, the width between the width restriction members 38*a* and 40*a* and also the width between the width restriction members 38*b* and 40*b* are adjusted to sizes that correspond to the widths of the sheet materials 214*a* and 214*b* that are to be held therein. Then, the positions of the rear end restriction members 134*a* and 134*b* are adjusted to correspond to the lengths in the feeding direction of the sheet materials 214*a* and 214*b* that are to be held. In FIGS. 2 and 14, a plurality of sheet materials 214*a* and 214*b* which are Western-style envelopes are held in a stacked manner in the sheet material-holding means 36*a* and 36*b*. The Western-style envelopes are stacked with the surfaces having a seal piece faced upwards and with the seal pieces arranged on one side (left side in FIGS, 14) in the direction of width, and are held in the sheet material-holding means 36*a* and 36*b*. In this case as clearly illustrated in FIG, 14, the one side where the seal pieces exist becomes slightly thicker than the other side. In the cassette 2 for feeding sheet materials that is illustrated, the front placing plates 170*a* and 170*b* of the placing members 166*a* and 166*b* are turned on the swing axis in the feeding direction (center axis of coupling shafts 186*a* and 186*b*) depending upon the difference in the thickness of sheet materials 214*a* and 214*b* in the direction of width. Under the condition shown in FIG, 14, the front placing plates 170*a* and 170*b* are turned by a slight angle toward a direction in which the left side becomes lower and the right side becomes higher, i.e., toward the counterclockwise direction. Therefore, despite the fact that the thickness of the stacked sheet materials 214*a* and 214*b* changes to a considerable degree in the direction of width, the upper surfaces of the uppermost sheet materials 214*a* and 214*b* are not tilted in the direction of width but are maintained substantially horizontal. Before the cassette 2 for feeding sheet materials is loaded onto the image forming machine, both sides of the front ends of the uppermost sheet materials 214a and 214b come in contact with the limit protuberances 116a, 118a and 116b, 118b, preventing the placing members 116a, 116b and the sheet materials 214a, 214b placed thereon from rising.

The sheet materials 214a and 214b are held in the sheet material-holding means 36a and 36b as required, the cover member 16 is closed as indicated by solid lines in FIGS. 1 and 2, and then the cassette 2 for feeding sheet materials is loaded onto the required position in the image forming machine. As illustrated in FIGS. 2 and 14, the image forming machine is provided with the reed switch 22 mentioned earlier, as well as a feeding means 216 and a feeding path defining member 218. The feeding means 216 includes a rotary shaft 220, and feeding rollers 222a and 222b attached to the rotary shaft. The feeding path defining member 218 has a feeding path defining surface 224 that arcuately extends forwardly and upwardly from the front of the sheet material-feeding cassette 2. When the cassette 2 for feeding sheet materials is loaded onto the image forming machine as required, the uppermost sheet materials 214a and 214b of the sheet materials 214a and 214b stacked and held in the sheet material-holding means 36a and 36b are pressed against the feeding rollers 222a and 222b. Therefore, the placing members 36a and 36b, as well as the front ends of the sheet materials 214a and 214b are slightly lowered against the resilient urging action of the resilient urging means 196a and 196b (as well as 180a and 180b), and the uppermost sheet members 214a and 214b are downwardly separated away from the limit protuberances 116a, 118a and 116b, 118b. As the feeding rollers 222a and 222b are rotated by a predetermined amount in the counterclockwise direction in FIG. 2, the uppermost sheet material 214a is fed forward from the sheet material-holding means 36a, and the uppermost sheet material 214b is fed forward from the sheet material-holding means 36b. As mentioned earlier, the stacked sheet materials 214a and 214b have thicknesses that vary to a considerable degree in the direction of width. However, variation in the thicknesses are compensated by the turn of the front placing plates 170a and 170b on the swing axis in the feeding direction, and the uppermost sheet materials 214a and 14b are not tilted in the direction of width but are maintained substantially horizontally to be pressed onto the feeding rollers 222a and 222b. Therefore, the uppermost sheet materials 214a and 214b are not tilted in the direction of width but are fed straight. As simply indicated by two-dot chain lines in FIG. 2, the sheet materials 214a and 214b that are fed are further forcibly guided forwards and upwards by the guiding action of the guide portions 126a, 128a, 126b and 128b, and are conveyed toward the feeding path defining surface 224. When the guide portions 126a 128a, 126b and 128b are not provided, experiments conducted by the present inventors proved that the sheet materials 214a and 214b that are curved in the direction of width tend to be slightly tilted in the direction of width as they travel along the feeding path defining surface 224. On the other hand when the guide portions 126a, 128a, 126b and 128b are provided in order to forcibly guide the sheet materials 214a and 214b upwardly and forwardly at the front end of the cassette 2 for feeding sheet materials, then the sheet materials 214a and 214b can travel straight along the feeding path defining surface 224 even when the sheet materials 214a and 214b are curved in the direction of width. In case two or more sheet materials 214a and 214b are fed forward in a stack from the sheet material-holding means 36a and 36b, the sheet materials 214a and 214b other than the uppermost sheet materials 214a and 214b are prevented from travelling by the action of the friction members 130a, 132a, 130b and 132b that are stuck to the upper surfaces of guide portions 126a, 128a, 126b and 128b. Thus, the plurality of sheet materials 214a and 214b are prevented from being fed in a stack.

Though preferred embodiments of the cassette for feeding sheet materials constituted according to the present invention have been described above in detail with reference to the accompanying drawings, it should be noted that the present invention is in no way limited to the above embodiments only but can be modified or varied in a variety of other ways without departing from the scope of the present invention.

What we claim is:

1. A cassette for feeding sheet materials comprising a container body, having an upper surface that is at least partly opened, and at least two sheet material-holding means that are arranged in said container body in parallel in the direction of width, wherein each of said sheet material-holding means includes a pair of width restriction members, each pair of width restriction members constituted by a width restriction member of a first side and a width restriction member of a second side, said width restriction members being so disposed that their positions can be freely adjusted in the direction of width and the sheet materials are held between said pairs of width restriction members, the width restriction members of the first side being coupled to each other so as to be movable as a unitary structure in the direction of width, the width restriction members of the second side being coupled to each other so as to be movable as a unitary structure in the di ection of width, and said width restriction members of the first side and said width restriction members of the second side being coupled to each other so that they are movable in synchronism in a direction to approach each other or in a direction to separate away from each other.

2. A cassette for feeding sheet materials according to claim 1, further comprising a coupling member of the first side that extends in the direction of width and couples said width restriction members of the first side to each other as a unitary structure, a coupling member of the second side that extends in the direction of width and couples, said width restriction members of the second side to each other as a unitary structure, a pair of racks on said coupling member of the first side and said coupling member of the second side, and a pinion coupling said racks together.

3. A cassette for feeding sheet materials according to claim 1, further comprising brake means to suppress the movement of the width restriction members of said first side and said second side in the direction of width.

4. A cassette for feeding sheet materials according to claim 3, wherein said brake means includes a plurality of brake members that are arranged in relation to each of said width restriction members of the first side and the second side and that are movable between an acting position and a non-acting position, and a single operation member coupled to said plurality of brake members, and wherein when said operation member is manually operated to bring said brake members to said acting position, said brake members are pressed onto said width restriction members of the first side and the second side to suppress the movement of said width restriction members of the first side and the second side in the direction of width, and when said operation member is manually operated to bring said brake members to said non-acting position, said brake members are released from being pressed onto the width restriction members of the first side and the second side to permit said width restriction members of the first side and the second side to move in the direction of width.

5. A cassette for feeding sheet materials according to claim 4, wherein said brake members are made of a material having a high coefficient of friction.

6. A cassette for feeding sheet materials according to claim 1, wherein each of said sheet material-holding means includes a rear end restriction member that is so disposed so that its position can be freely adjusted in the feeding direction, and the sheet materials are held in front of said rear end restriction member.

7. A cassette for feeding sheet materials according to claim 6, further comprising means coupling said rear end restriction members of said sheet material-holding means to each other so as to be movable as a unitary structure in the direction of feeding.

8. A cassette for feeding sheet materials according to claim 7, wherein said coupling means comprises a coupling member that extends in the direction of width.

9. A cassette for feeding sheet materials according to claim 8, wherein said coupling member includes an operation member positioned at the center in the direction of width, and said operation member is manually movable in the feeding direction in order to move said rear end restriction members in the feeding direction.

10. A cassette for feeding sheet materials according to claim 9, further comprising locking means for releasably blocking the movement of said operation member in the feeding direction.

11. A cassette for feeding sheet materials according to claim 10, wherein said operation member is mounted on said coupling member to be movable in a predetermined direction, and said locking means includes a plurality of engageable pawls arranged in the feeding direction, an engaging pawl formed on said operation member, and resilient urging means for resiliently urging said engaging pawl in a direction to engage with said engageable pawls, and wherein said operation member is movable against the resilient urging action of said resilient urging means to separate said engaging pawl away from said engageable pawl, so that said operation member is allowed to move in the feeding direction.

12. A cassette for feeding sheet materials according to claim 1, wherein each of said sheet material-holding means includes a placing member of which at least the front portion is so mounted as to ascend or descend, and resilient urging means for resiliently urging the front portion of said placing member upwards, and at least the front portions of the sheet materials are placed on said placing member.

13. A cassette for feeding sheet materials according to claim 12, wherein at least the front portion of said placing member is capable of assuming at least locally different heights in the direction of width.

14. A cassette for feeding sheet materials according to claim 13, further comprising a first swing axis means extending in the feeding direction, and wherein at least the front portion of said placing member is allowed to turn on said first swing axis means.

15. A cassette for feeding sheet materials according to claim 14, wherein said placing member comprises a second swing axis means extending in the width direction, a rear placing plate that is mounted to turn on said second swing axis means, and a front placing plate that is mounted to turn on said first swing axis means.

16. A cassette for feeding sheet materials according to claim 12, wherein said width restriction members include guide portion formed at the front ends of said width restriction members of the first side and the second side and extending upwardly and forwardly beyond the front end of the sheet materials placed on said placing member.

17. A cassette for feeding sheet materials according to claim 16 further comprising a friction member having a large coefficient of friction and disposed on the upper surfaces of said guide portions.

18. A cassette for feeding sheet materials comprising a container body having an upper surface that is at least partly opened and at least two sheet material-holding means that are arranged in said container body in parallel in the direction of width, each of said sheet material-holding means including a rear end restriction member that is so disposed that its position can be freely adjusted in the feeding direction, and the sheet materials are held in front of said rear end restriction member, and means coupling said rear end restriction members to each other so as to be movable as a unitary structure in the feeding direction.

19. A cassette for feeding sheet materials according to claim 18, further comprising a coupling member extending in the direction of width and coupling said rear end restriction members of said sheet material-holding means to each other.

20. A cassette for feeding sheet materials according to claim 19, wherein said coupling member includes an operation member at a central position in the direction of width, and said operation member is manually movable in the feeding direction in order to move said rear end restriction members in the feeding direction.

21. A cassette for feeding sheet materials according to claim 20, further comprising locking means for releasably blocking the movement of said operation member in the feeding direction.

22. A cassette for feeding sheet materials according to claim 21, wherein said operation member is mounted on said coupling member to be movable in a predetermined direction, and said locking means includes a plurality of engageable pawls arranged in the feeding direction, an engaging pawl formed on said operation member, and resilient urging means for resilient urging said engaging pawl in a direction to engage with said engageable pawls, and wherein said operation member is moveable against the resilient urging action of said resilient urging means to separate said engaging pawl away from said engageable pawl, so that said operation member is allowed to move in the feeding direction.

23. A cassette for feeding sheet materials according to claim 18, wherein each of said sheet material-holding means includes a placing member of which at least the front portion is so mounted as to ascend or descend, and resilient urging means for resiliently urging the front portion of said placing member upwards, and at least the front portions of the sheet materials are placed on said placing member.

24. A cassette for feeding sheet materials according to claim 23, wherein at least the front portion of said placing member is capable of assuming at least locally different heights in the direction of width.

25. A cassette for feeding sheet materials according to claim 24, further comprising a first swing axis means extending in the feeding direction, and wherein at least the front portion of said placing member is allowed to turn on said first swing axis means.

26. A cassette for feeding sheet materials according to claim 25, wherein said placing member comprises a second swing axis means extending in the width direction, a rear placing plate that is mounted to turn on said second swing axis means, and a front placing plate that is mounted to turn on said first swing axis means.

27. A cassette for feeding sheet materials according to claim 23, wherein said width restriction members include guide portions formed at the front ends of said width restriction members of the first side and the second side and extending upwardly and forwardly beyond the front end of the sheet materials placed on said placing member.

28. A cassette for feeding sheet materials according to claim 27, further comprising a friction member having a large coefficient of friction and disposed on the upper surfaces of said guide portions.

29. A cassette for feeding sheet materials comprising a container body, having an upper surface that is at least partly opened, and a sheet material-holding means that is arranged in said container body, said sheet material-holding means including a placing member of which at least the front portion is mounted to ascend and descend; resilient urging means for resiliently urging the front portion of said placing member upwardly; at least the front portions of the sheet materials being placed on said placing member, at least the front portion of said placing means being capable of assuming at least locally different heights in the direction of width; a first swing axis means extending in the feeding direction; at least the front portion of said placing member being capable of turning on said first swing axis means; said placing member being constituted by a second swing axis means extending in the width direction, a rear placing plate that is mounted to turn on said second swing axis means, and a front placing plate that is mounted to turn on the first swing axis means.

* * * * *